United States Patent [19]

Gattman

[11] Patent Number: 4,496,025

[45] Date of Patent: Jan. 29, 1985

[54] FOOT SUPPORT FOR LADDER

[76] Inventor: John W. Gattman, 801 E. Sixth St., Muscle Shoals, Ala. 35660

[21] Appl. No.: 495,145

[22] Filed: May 16, 1983

[51] Int. Cl.[3] ..... E06C 7/16; A43B 3/00

[52] U.S. Cl. ..... 182/121; 182/134; 182/221; 36/113

[58] Field of Search ..... 182/121, 120, 122, 134, 182/135, 136, 221; 36/113

[56] References Cited

U.S. PATENT DOCUMENTS

| | | | |
|---|---|---|---|
| 857,430 | 6/1907 | Youngquist | 182/134 |
| 1,091,277 | 3/1914 | Bloom | 182/134 |
| 2,282,133 | 5/1942 | Horton | 182/121 |
| 2,432,206 | 12/1947 | Mott | 182/121 |
| 2,498,944 | 2/1950 | Dyer | 182/121 |
| 2,772,927 | 12/1956 | Woodward | 182/121 |
| 3,112,011 | 11/1963 | Fiste | 182/134 |

*Primary Examiner*—Reinaldo P. Machado

*Attorney, Agent, or Firm*—C. A. Phillips; Michael L. Hoelter

[57] ABSTRACT

A foot support adapted to be employed with a ladder which employs a generally flat plate member attachable to a shoe and a bracket extending upward and then hooking downward from the toe end of the support. By this configuration, the foot and shoe of a user would basically be supported by a support resting on one rung of a ladder, and further support being provided by the bracket hooking over the next upper rung of the ladder.

11 Claims, 11 Drawing Figures

FOOT SUPPORT FOR LADDER

TECHNICAL FIELD

This invention relates generally to devices for assisting one in climbing and supporting oneself on a ladder, and particularly to devices of this category which are adapted to be strapped to each of one's feet.

PRIOR ART

Ladders are constructed with spaced foot supports, or rungs, extending between two frame members. In order to achieve portability, ladders are made lightweight; and to assist in this, the rungs, upon which one must stand, have a small cross section and thus supporting surface, particularly when compared with the area of the bottom of one's foot. Thus, when one climbs or stands on a rung of a ladder, his weight must be transmitted through a relatively small region of his foot, and this can be quite uncomfortable. In addition to this problem, unless one has his feet planted just right on a ladder, there is a tendency for the feet, or, in climbing, one foot, to rock; and, if one is not careful, he may actually slip from the ladder.

While the applicant is aware of there having been described in the patent literature certain portable platforms to assist one's stance on a ladder, e.g., U.S. Pat. Nos. 2,282,133 and 2,772,927, the applicant is unaware of there having been developed any device which would enable one to comfortably and securely climb and stand on a ladder.

It is an object of this invention to meet these deficiences and to provide a comfortable and safe foot support for climbing and standing on a ladder.

SUMMARY OF THE INVENTION

In accordance with this invention, a foot support is constructed to include a rigid, generally planar platform sized to approximate, or be slightly larger than, the area of the bottom of a shoe, this platform being adapted to generally rest on one rung of a ladder. Additionally, the platform is supported on a second and upper rung of a ladder by a bracket which is attached to a front end of the platform and extends upward and over the upper rung. The shoed foot of a wearer is secured to the platform by straps attached to the platform.

DETAILED DESCRIPTION OF THE INVENTION

Figure 2:
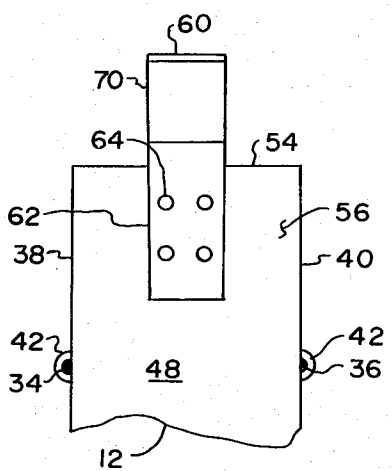
FIG. 2 is a partial bottom view of the embodiment of the invention shown in FIG. 1, and particularly showing a front portion of the embodiment.
Figure 1:
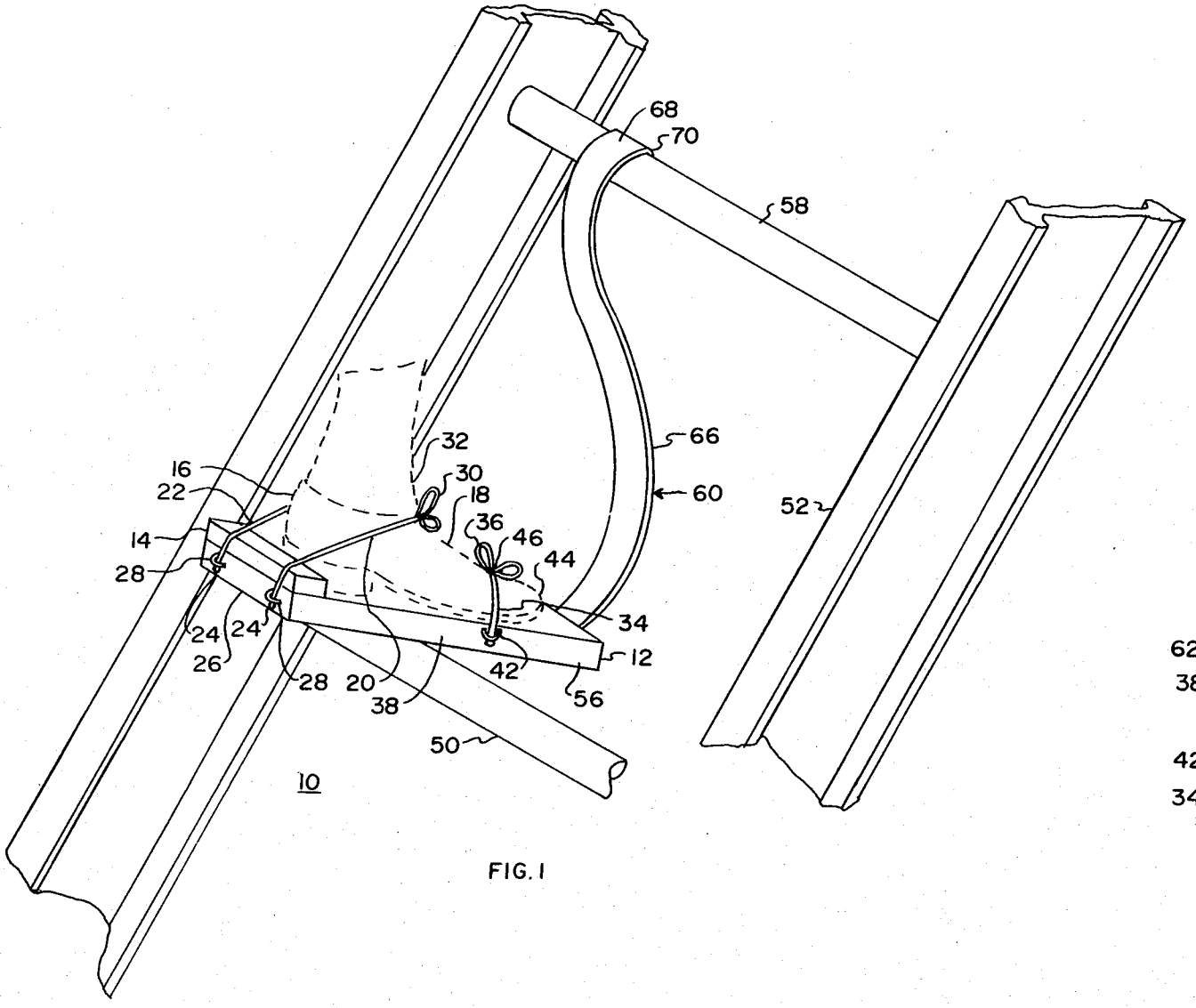
FIG. 1 is a pictorial view, partially cut away, illustrating an embodiment of the invention.

Referring initially to FIGS. 1 and 2, a ladder foot support stand 10 is constructed having a platform 12, typically made of wood, metal, or plastic and configured rectangularly to have an aproximate length of 10 to 15 inches and a width of approximately 4 to 5 inches and thus sufficiently to cover the dimension of most size shoes. A block 14, typically of the same material as platform 12, or as an extension of it, is positioned across the rear of platform 12, extending upward a distance of approximately ½ to ¾ inch. It functions to provide a heel stop against which the rear of heel 16 of shoe 18 of a wearer is supported.

A first or rear pair of lace or tie-type straps 20 and 22 are each secured on end 24 to the rear side 26 of platform 12 by staples 28. When in use, as shown, these tie straps extend over block 14 and around opposite sides of shoe 18 and are tied together by knot 30 around the ankle of a user's foot 32. In this manner, the combination of block 14 and straps 20 and 22 effectively secure heel 16 of shoe 18 against movement on platform 12.

A second or front pair of lace tie-type straps 34 and 36 secure the front of a user's foot 32 on platform 12. One end of each of straps 34 and 36 are secured to a discrete side of sides 38 and 40 of platform 12 by staples 42. As shown, these straps then extend across and over the front or toe region 44 of user's shoe 18 and are tied together in a knot 46. Thus, the front region of a user's foot 32 is laterally secured, particularly being secured against side-to-side movement of the foot on platform 12.

The bottom side 48 of platform 12 generally rests on rung 50 of ladder 52. Typically, the area of contact with rung 50 is along a transverse narrow region of bottom side 48 somewhat closer to rear side 26 of platform 12 between front side 54 and rear side 26 of platform 12. The front region of platform 56 is supported on a second or upper rung 58 of ladder 52, this being accomplished by a curved bracket 60 which is attached to platform 12. Bracket 60 (FIG. 2) is generally flat over one end region 62 and is secured by bolts 64 to bottom-side 48 of platform 12. Bolts 64 are arranged in a pattern which prevents bracket 60 from pivoting on platform 12. This feature may be enhanced by countersinking bracket 60 into bottom side 48 of platform 12. The mid region 66 of bracket 60 is curved upward, and an opposite end region 68 is curved outward and downward in the shape of a hook, and hook 70 is sized to engage rung 58 of ladder 52. By the combination of support from rungs 50 and 58, portions of one's weight are distributed between and on rungs 50 and 58.

In actual use, a user would employ a ladder foot support stand 10 on each foot 32, with each stand 10 being secured as shown in FIG. 1. To climb a ladder as, for example, ladder 52, the user would lift one foot sufficiently high and appropriately positioned to enable hook 70 to extend and lock around rung 58, rung 58 being just above a lower rung 50, on which platform 12 would make contact. Then, typically, the user would raise his other foot and repeat the process with it, except that the second foot would be raised to a point where the platform attached to it would initially be raised just above rung 58, and curved bracket 60 attached to it would be hooked over the next rung up from rung 58. Then, the platform on the second foot would be lowered to rest on rung 58. The process would be continued by elevating the first foot, and so on.

Alternately, a user is able to climb ladder 52 in a normal fashion without securing hook 70 around the next higher rung above that rung upon which platform 12 contacts. This manner of climbing, although not as safe and secure as that manner mentioned above, is faster and permits a user to reach his working elevation quickly and with a minimum of effort.

When one reaches the desired height, both feet are raised such that platforms 12 on both feet rest on the same rung with brackets 60 from each stand 10 being hooked over the next higher rung. For a comfortable and secure stance, the user causes the foot supports to tilt forward slightly and thereby distribute the user's weight between upper and lower rungs of a ladder. This incline enhances the safety of the user since the axis of his body is not vertical but pitched forward between a vertical line and the longitudinal axis of the ladder.

Whenever the user wishes to move to a different elevation, either upward or downward, he lifts each of his feet, one at a time, to unhook bracket 60 from the next higher rung and then moves to a new location, either upward or downward. Once at the new location, the user simply hooks brackets 60 over the next higher rung, as previously described.

Figure 4:
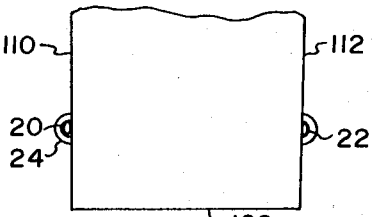
FIG. 4 is a bottom pictorial view, partially cut away, of the embodiment illustrated in FIG. 3.
Figure 3:
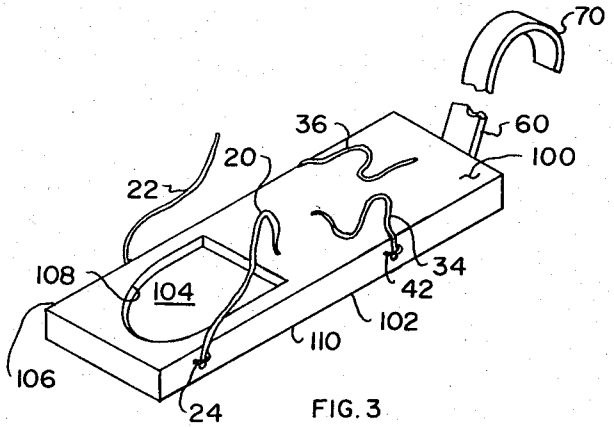
FIG. 3 is a pictorial view, partially cut away, illustrating another embodiment of the invention.

Referring now to FIGS. 3 and 4, there is illustrated a second embodiment of the invention. In this embodiment, the top surface 100 of platform 102 is formed having a heel indentation 104 in end region 106. This indentation 104 and its stop surface 108 are sized to accept the heel of a user's shoe 18 and prevent heel 16 from sliding on platform 102 in any direction. Additionally, tie straps 20 and 22 function directly to hold the heel of a shoe down into indentation 104, and in keeping with this, tie straps 20 and 22 are attached by staples 24 to the sides 110 and 112 of platform 102, as particularly illustrated in FIG. 4. Otherwise, the structure of the embodiment shown in FIG. 3 is identical to the embodiment shown in FIG. 1, and the same component designations are employed.

Figure 6:
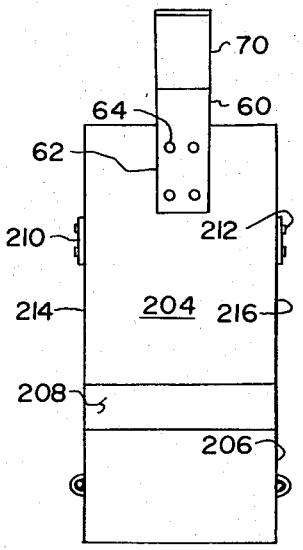
FIG. 6 is a bottom pictorial view of the embodiment illustrated in FIG. 5.
Figure 5:
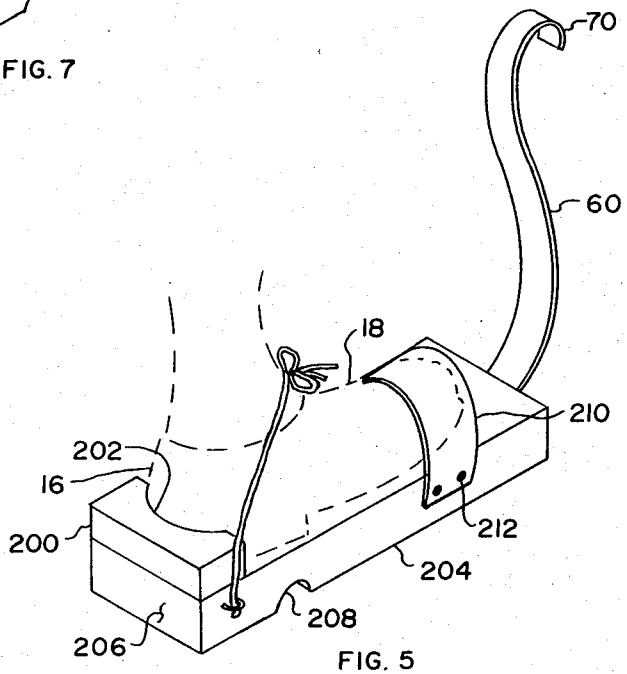
FIG. 5 is a pictorial view of yet another embodiment of the invention.

Referring now to FIG. 5, there is illustrated a third embodiment of the invention which incorporates three variations in structure from that shown in FIG. 1. First, heel stop or block 200 is modified to provide a curved front surface 202, and by it (as shown) there is a greater area of contact between the heel 16 of user's shoe 18 and heel block 200 and thus greater protection against lateral slippage of the shoe. Second, a notch is formed transversely in the underside 204 of platform 206, being positioned approximately 30% of the length of platform 206 from the back of platform 206. Notch 208 is sized to fit on and around a rung of a ladder to prevent platform 206 from sliding either toward or away from the ladder. Third, the toe or front tie straps as employed in the embodiments of FIGS. 1 and 3 are replaced by a single strap 210 which is attached, such as by screws 212, to opposite sides 214 and 216 of platform 206 (FIG. 6). Typically, strap 210 would be 1 to 1½ inches in width and constructed of a yieldable material to thus accommodate different size shoes. Alternately, it may be rigid or semi-rigid and taper forward to totally enclose the front of one's shoe.

Figure 7:
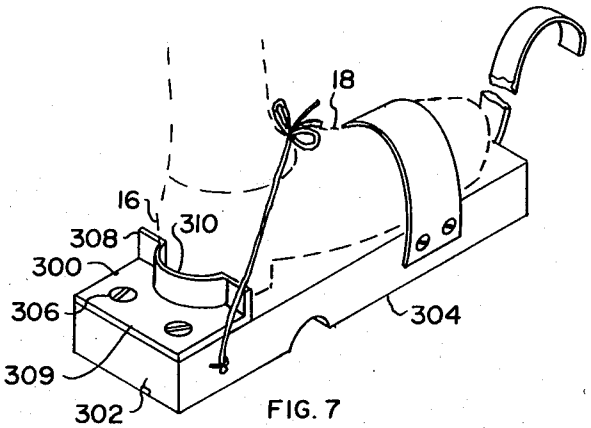
FIG. 7 is a pictorial view, partially cut away, illustrating still another embodiment of the invention.

Referring now to FIG. 7, there is illustrated a fourth embodiment of the invention which incorporates a variation in structure from that shown in FIG. 5. Heel stop or block 300 is modified to consist of a unitary piece of material which is bolted or otherwise secured to the rear portion 302 of platform 304 by bolts 306. One end region 308 of block 300 is turned upward approximately 90° with respect to the top 309 of platform 304, and this end region 308 is configured to provide a curved front surface 310 which increases the area of contact between heel 16 of user's shoe 18 and heel block 300.

Figure 8:
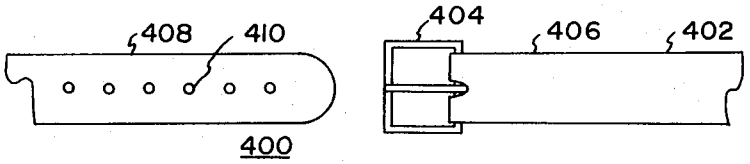
FIG. 8 is a detailed view, partially cut away, of the buckle assembly.

Referring now to FIG. 8, there is illustrated an embodiment for securing user's foot 32 to foot support stand 10. In this embodiment, the tie-type straps previously mentioned are replaced with a buckle-type clasp 400 which includes a lace 402 having a buckle 404 secured to end 406 and a lace 408 having a plurality of spaced holes 410 therein. These holes 410 are sized so as to allow engagement of lace 408 with buckle 404, and thus, when laces 402 and 408 are positioned around user's foot 32 and are secured to each other, they secure user's foot 32 to support stand 10.

Figure 9:
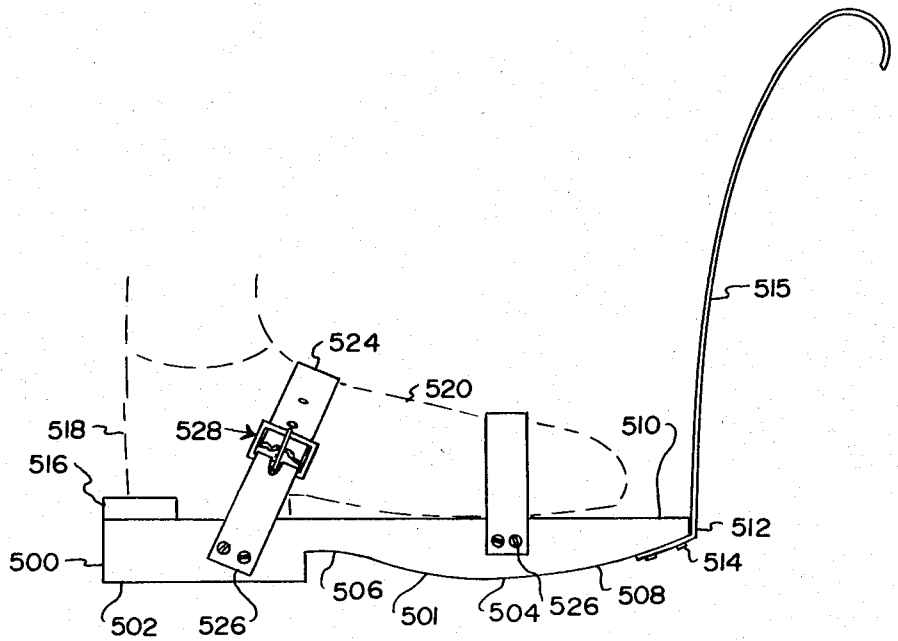
FIG. 9 is a side view illustrating yet another embodiment of the invention.
Figure 10:
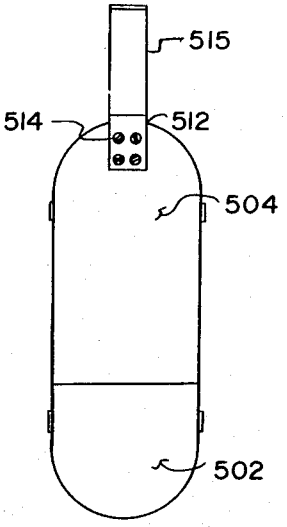
FIG. 10 is a bottom view of the embodiment illustrated in FIG. 9.
Figure 11:
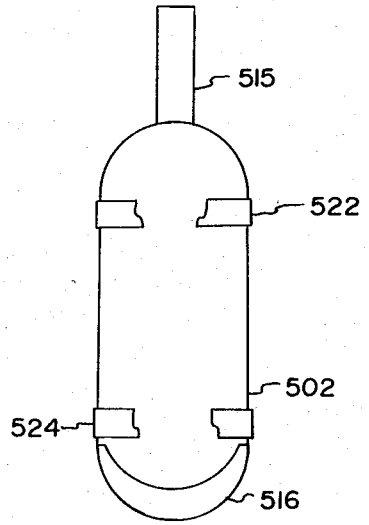
FIG. 11 is a top view, partially cut away, of the embodiment illustrated in FIG. 9.

Referring now to FIGS. 9–11, there is shown another embodiment of the invention. As illustrated, the bottom surface 501 of foot support 500 is configured similar to the bottom of a regular shoe having a heel end region 502, a toe region 504, and an intermediately notched region 506. This notced region 506 would engage the rung of a ladder to support the user and prevents foot support 500 from sliding forward on the ladder rung. Notched region 506 permits foot support 500 to partially pivot on the ladder rung while still providing adequate support to the user. This allows the user to pivot a foot, and thus a foot support 500, while standing on a ladder without affecting the support provided him.

Toe region 504 is curved having an upwardly tapered surface 508 which contacts the ground as a user walks in these foot supports. Thus, tapered surface 508 is rolled forward during the walking process, and heel end region 502 pivots upward as would normally be the case while walking. The curvature of tapered surface 508 thus aids a user in walking with these foot supports strapped to his feet. A front portion 510 of toe region 504 is connected to bracket 512 via bolts or fasteners 514 (FIG. 10). These bolts 514 secure bracket 515 to bottom surface 501 of foot support 500.

As is better illustrated in FIG. 11, heel end region 502 has a notched heel stop 516 that provides lateral support in addition to back support for heel 518 of user's foot 520. Heel stop 516 need not rise significantly above the top of foot support 500 to be effective since its purpose is to provide a stop surface for user's foot 520 and to prevent this foot from sliding backward on foot support 500.

Front and back straps 522 and 524 restrain user's foot 520 onto the top of foot support 500, and these straps are secured to foot support 500 such as by bolts 526, as shown. Front strap 522 is illustrated as being a fixed continuous toe strap, but it may be made adjustable, such as by adding a buckle or snap assembly, if desired. Back strap 524 is illustrated as being adjustable by buckle assembly 528, but back strap 524 may also be made adjustable by being tied or otherwise secured by means not shown.

From the foregoing, it is to be appreciated that the applicant has provided a practical solution to the problem of comfortable and safe climbing and standing on a ladder, and the device which he has developed to do this is simple and inexpensive to manufacture.

I claim:

1. A support for supporting an individual shoe of a wearer on a ladder comprising:

a generally rigid, elongated platform having a generally planar upper surface and being sized to approximate the length and width dimensions of a single shoe, said platform having a front region and a back region to coordinately receive the toe and heel regions of a shoe, said platform including a vertically extending region in at least a portion of said back region of said upper surface and configured to block rearward movement of the heel of said shoe;

an elongated brace having a first end region fixedly secured to said front region of said platform, said brace extending upward above said front region and having an end region configured in the shape of an open U-shaped hook having a turned forward and downward region for removably extending over and partially around a rung of a ladder for supporting said front region of said platform, and the region below the opening formed by said open U-shaped hook being unobstructed, whereby any raising of said platform, and thereby said brace, will enable the support to be readily moved from one rung to another;

a transverse notch region in a bottom surface of said elongated platform, said notch region being positioned closer to said back region than said front region of said platform for inclining said platform forward and downward about a rung of a ladder; and securing means connected to said platform for securing a shoe and foot of a user to said platform.

2. A support as set forth in claim 1 wherein said back region of said platform includes a depression in said platform configured to accept the heel of a shoe, and said laterally extending wall comprises a rear side of said depression.

3. A support as set forth in claim 1 wherein said notch is circular.

4. A support as set forth in claim 1 wherein said securing means comprises at least one pair of flexible straps, each strap having one end secured to said platform and opposite ends being securable together.

5. A support as set forth in claim 4 wherein said one pair of flexible straps are connected between laterally spaced points of said back region of said platform, and said securing means includes an elongated toe strap having opposite ends secured to and between opposite sides of said front region of said platform.

6. A support as set forth in claim 4 wherein said securing means comprises two pairs of said straps, said first pair being connected on opposite sides of said front region of said platform, and said second pair being connected at laterally spaced points on said back region of said platform.

7. A support as set forth in claim 6 wherein said second pair of straps are connected to spaced points on opposite sides of said back region of said platform.

8. A support as set forth in claim 6 wherein said second pair of straps are connected to spaced points along a rear end side of said platform.

9. A support as set forth in claim 4 wherein said lateral wall is concave.

10. A support as set forth in claim 1 wherein the underside of said platform is curved in a vertical dimension having a discrete heel and sole region conforming generally to the underside of a shoe.

11. A support as set forth in claim 1 wherein said brace extends frontward, upward, and then rearward from said front region.

* * * * *